US005979057A

United States Patent [19]

Chao

[11] Patent Number: 5,979,057

[45] Date of Patent: Nov. 9, 1999

[54] RETRACTABLE KNIFE

[76] Inventor: Chien-Chuan Chao, No. 13, Lane 15, Sec. 2, Fuhsing Rd., S. Dist., Taichung, Taiwan

[21] Appl. No.: 09/084,210

[22] Filed: May 26, 1998

[30] Foreign Application Priority Data

Dec. 31, 1997 [CN] China ..... 86221744

[51] Int. Cl.[6] ..... B26B 1/08

[52] U.S. Cl. ..... 30/125; 30/162

[58] Field of Search ..... 30/162, 163, 335, 30/125

[56] References Cited

U.S. PATENT DOCUMENTS 2,605,545 8/1952 Weems ..... 30/125

FOREIGN PATENT DOCUMENTS 15028 6/1896 United Kingdom ..... 30/335

*Primary Examiner*—Douglas D. Watts

*Attorney, Agent, or Firm*—Bacon & Thomas, PLLC

[57] ABSTRACT

A retractable knife includes two shells that are secured together by a hook and anchor, and by a cam lever that can be pivoted to separate the two shell and enable quick and easy exchange of blades.

9 Claims, 5 Drawing Sheets

RETRACTABLE KNIFE

FIELD OF THE INVENTION

The present application relates to a retractable knife, and more particularly to a retractable knife having an improved structure that enables the retractable knife to extend and retract the blade easily and readily.

BACKGROUND OF THE INVENTION

The body of a conventional retractable knife 50, as shown in FIGS. 6 and 7, includes a main portion assembled from casings 52 and 54. A slot is longitudinally defined in the top face of the main structure and a protruding tip 56 can be pushed back and forth therein. A mount for fixing a blade 60 is integrally formed with the protruding tip 56. The blade 60 is retractable by pulling the protruding tip 56 to the back of the slot.

The conventional retractable knife is convenient for users to cut items such as papers, but is inconvenient in that the casings 52, 54 are securely attached by a screw 58, making it difficult to replace the blade. To replace the blade 60, a user has to first unscrew the screw 58, take out the blunt/unsuitable old blade 60, fit the new blade 60 into place and then screw in the screw 58 to secure the two casings 52, 54. The present invention provides a creative and novel means for solving the problems mentioned above.

SUMMARY OF THE INVENTION

It is an object of the present invention to provide an improved structure for a retractable knife. The main characteristic of the present application includes a first shell and a second shell. An aperture is integrally defined within a cam lever and is sized to receive a protuberance. A slot is integrally defined in the first shell and is dimensioned to receive a hook. Therefore, the user can assemble and dissemble the retractable knife safely and swiftly.

The foregoing advantages and objects of the invention will be understood more clearly when taken in light of drawings of the present application.

DETAILED DESCRIPTION OF THE PREFERRED EMBODIMENT

Figure 1:
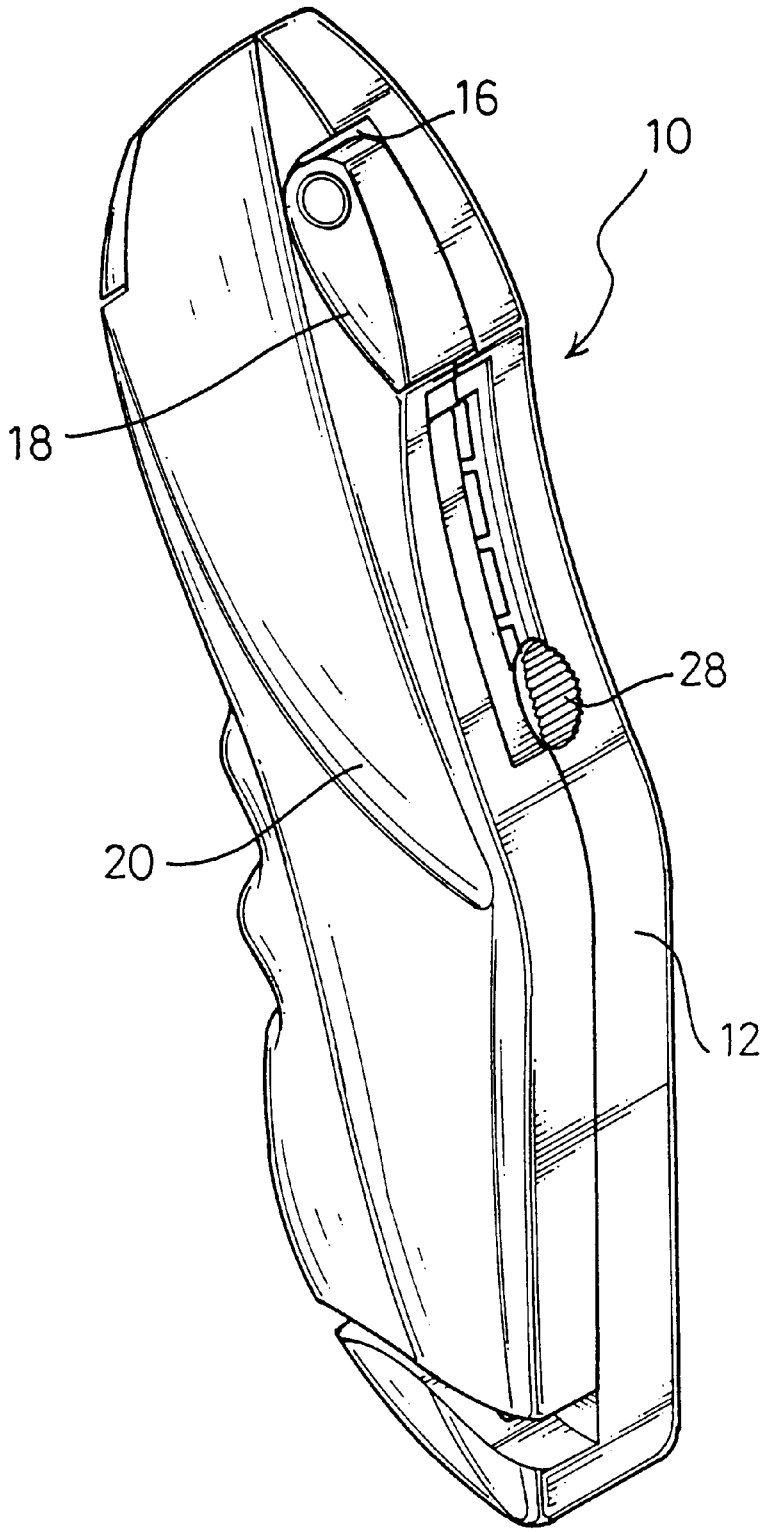
FIG. 1 is a perspective view of a retractable knife according to the present invention.
Figure 2:
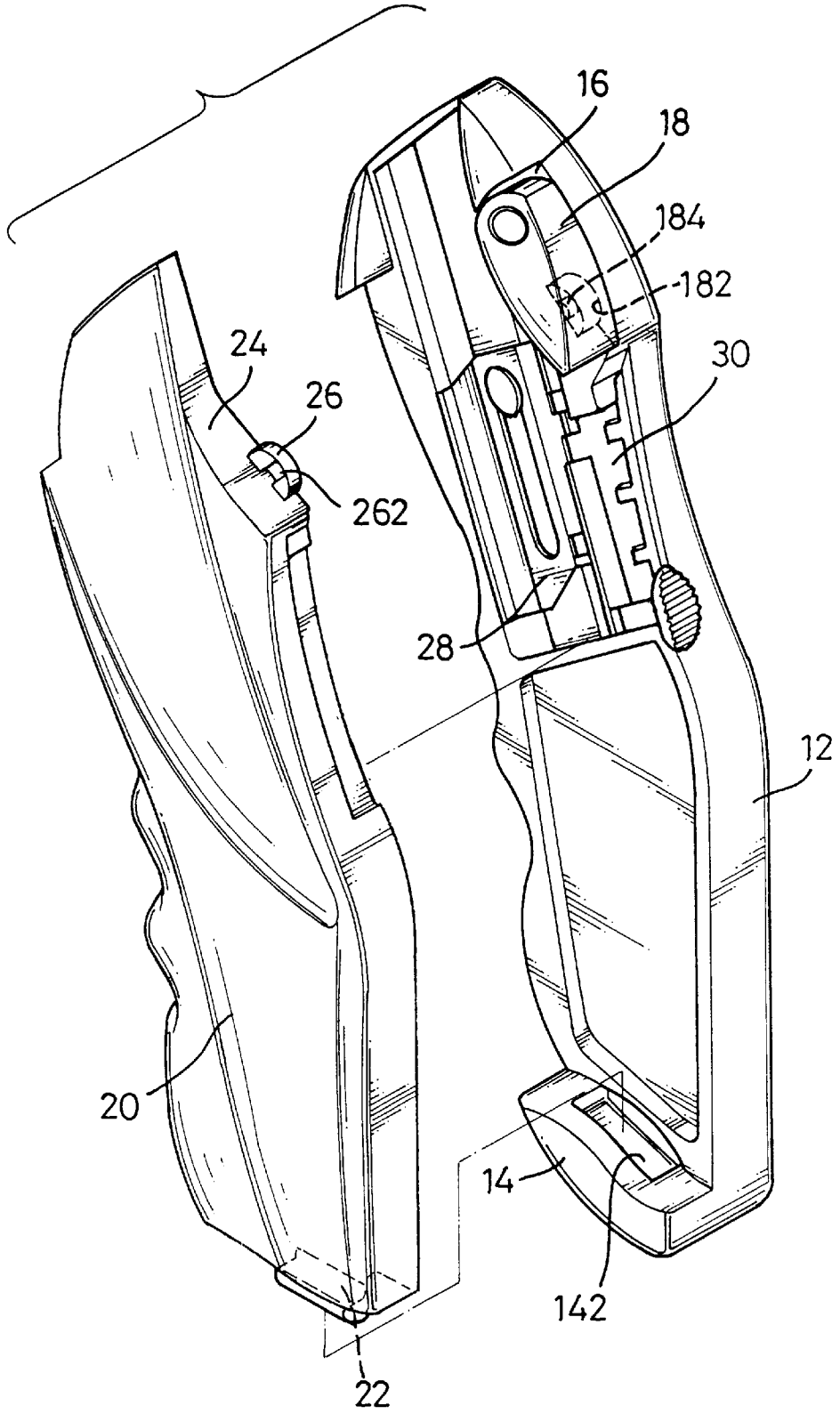
FIG. 2 is an exploded perspective view of the retractable knife of FIG. 1.
Figure 3:
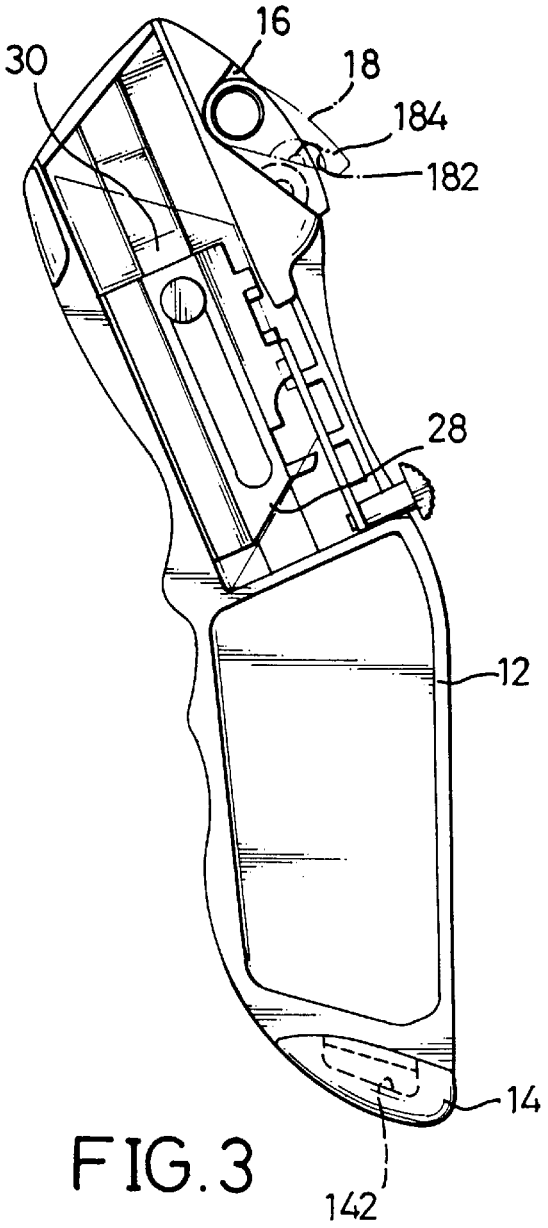
FIG. 3 is a side view in partial section of the retractable knife of FIG. 1 with the second shell removed therefrom.

Referring to FIGS. 1 and 2, a retractable knife 10 includes a housing comprising a first shell 12 and a second shell 20. A guide rail (not numbered) is formed between corresponding portions of the first and second shells 12, 20. A blade 30 can be extended from or retracted into the retractable knife 10 by being slid along the guide rail. However, operation of the blade 30 is conventional and thus not described in further detail.

Figure 5:
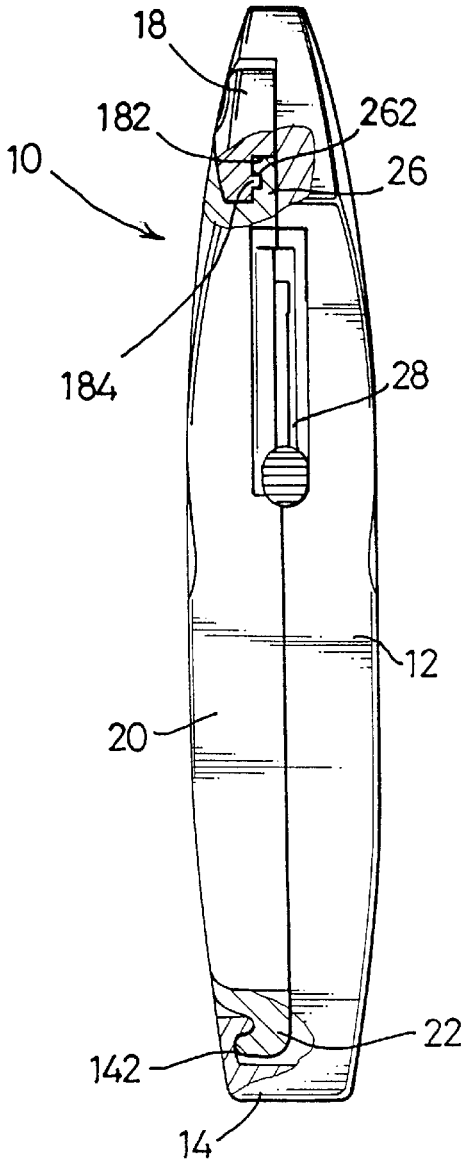
FIG. 5 is a top plan view in partial section of the retractable knife of FIG. 1.
Figure 4:
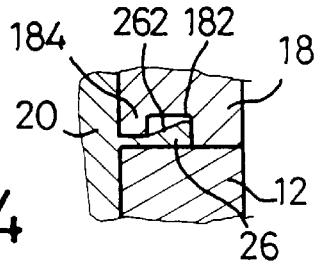
FIG. 4 is a partially cross-sectional view of a retractable knife according to the present application.
Figure 6:
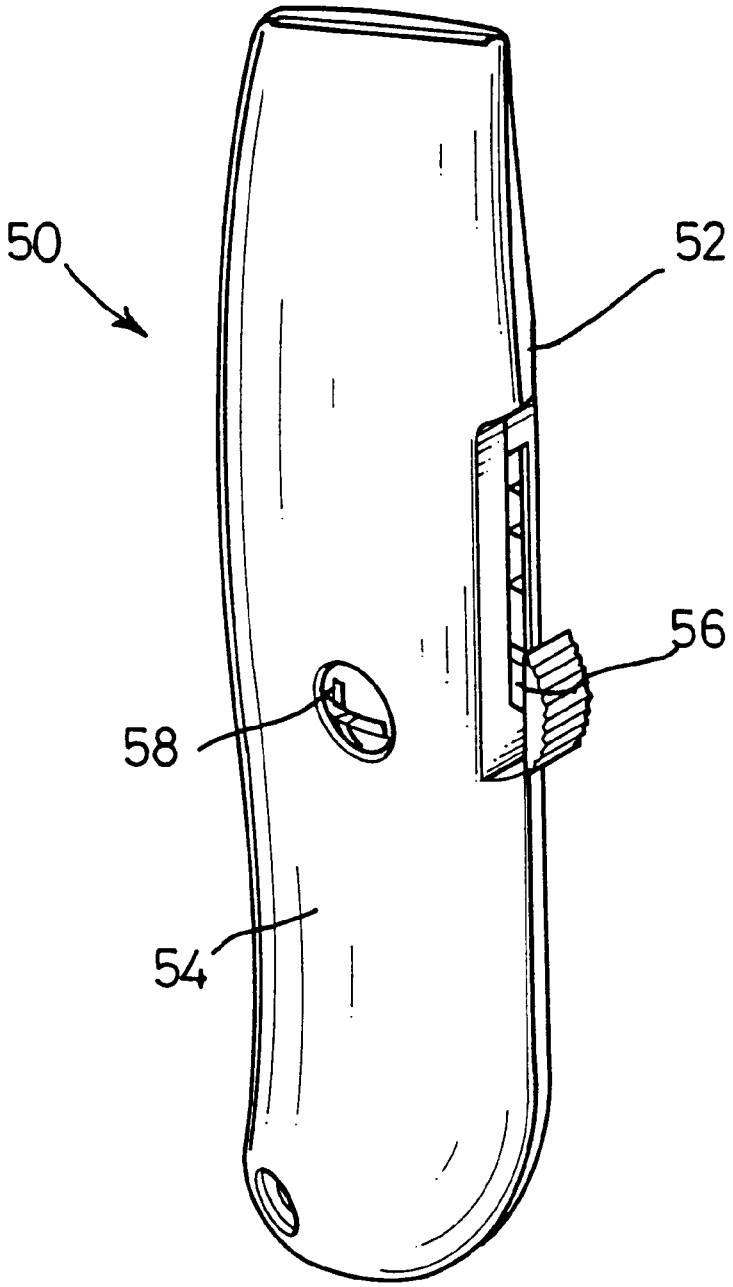
FIG. 6 PRIOR ART
FIG. 6 is a perspective view of a conventional retractable knife.
Figure 7:
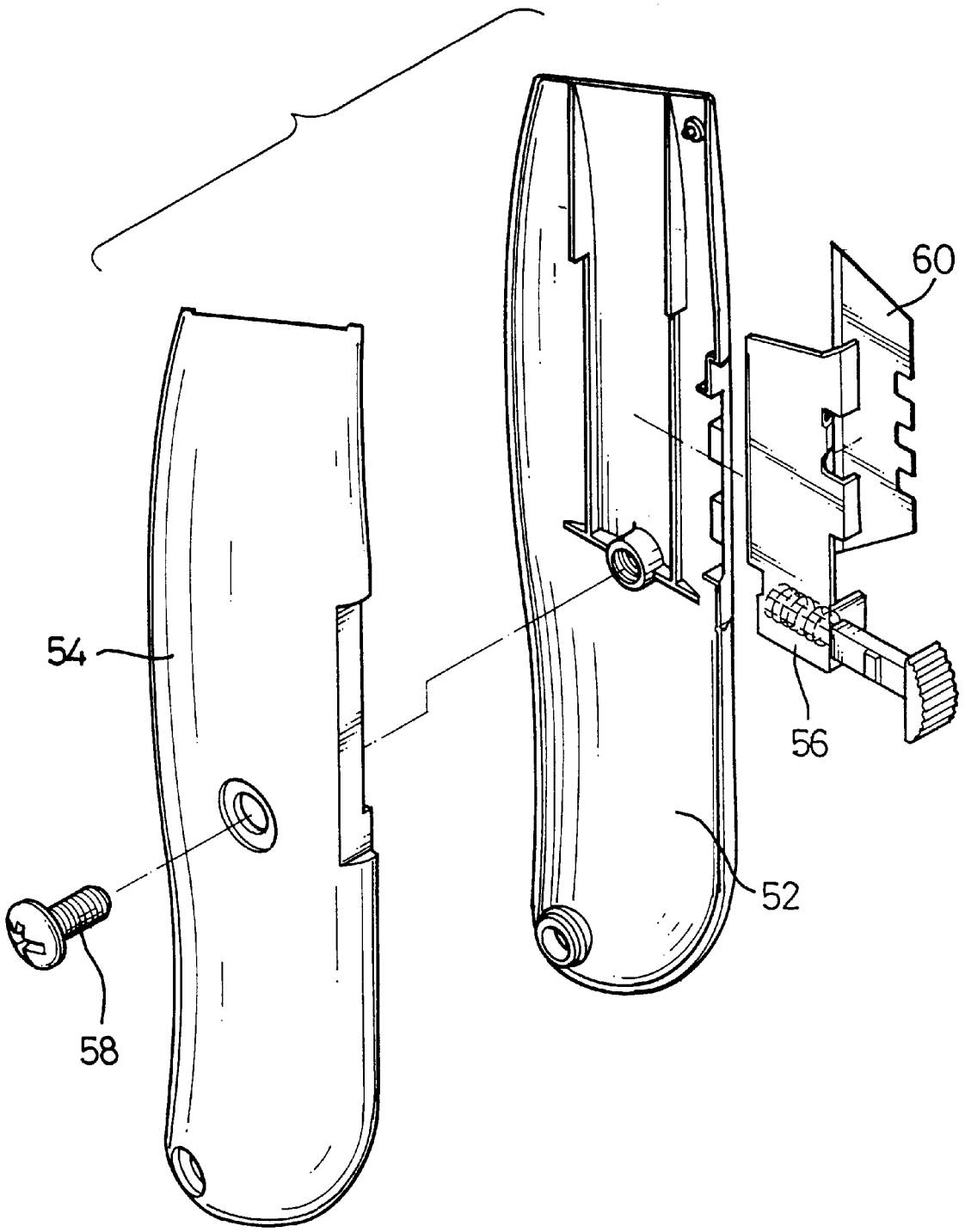
FIG.7 PRIOR ART
FIG. 7 is an exploded perspective view of a conventional retractable knife.

An anchor is integrally is formed on an inner face of the back bottom end of the lower portion of the first shell 12, such that the first shell 12 is substantially shaped as an "L" when viewed from the top, as shown in FIG. 5. A hook 22 is formed on a rear end face of the second shell 20, and is configured to be received in a indent 142 defined in anchor 14.

The first shell 12 defines an opening 16 in a top face thereof near the front and a cam lever 18 is pivotally received therein. The cam lever 18 includes two longitudinal side faces. One of the longitudinal side faces abuts a sidewall partly defining the opening 16 of the first shell 12, and defines an aperture 182 which is substantially semi-circular, and a recess 184 is defined in the aperture 182.

The second shell 20 defines a cutout in a top face thereof that is configured to receive a portion of the cam lever 18 therein.

A protuberance 26 integrally extends from the top face forming the cutout of the second shell 20. The protuberance is configured to be received in the aperture 182 of the cam lever 18 when the first and the second shells 12, 20 are combined. The cam lever 18 abuts both the top face defining the opening 16 of the first shell 12 and the top face defining the cutout of the second shell 20. The recess 184 of the cam lever 18 engages a stud 262 of the protuberance 26. Thus, with the interlocking between the ridge 22 and the indent 142, contact between the protuberance 26 and the cam lever 18 results in secure yet releasable engagement between the first and second shell 12, 20. To release the engagement between the first and second shell 12, 20, the cam lever 18 is pivoted away therefrom and the stud 262 on the protuberance 26 disengages from the recess 184 of the cam lever 18. Sequentially, the second shell 20 is raised in relation to the first shell 20 such that the engagement between the ridge 22 and the slit 22 is eliminated.

Referring to FIG. 2, a user may replace the blade 30 of the retractable knife 10 by pivoting the cam lever 18 away from the first shell 12, whereupon the pin 184 of the cam lever 18 will be pulled away from the stud 262 of the protuberance 26. Meanwhile, the hook 22 of the second shell 20 is pulled away from the indent 142 of the first shell 12 by tilting the second shell 20 outwardly. It will be understood that the user may replace the blades without using screws, so the knife of the invention is much more efficient than the conventional retractable knife. The present invention indeed makes changes the to assemblage and dissemblage of the conventional retractable knife and is novel.

It is to be understand that the scope of the invention and of the claims is not limited by the illustrated embodiments, but extends to the equivalent structure as well.

What is claimed is:

1. A retractable knife including a first shell and a second shell which, when secured together, form a housing for a knife blade, comprising:

a cam lever received in the first shell and arranged to be pivoted from a first position to a second position;

a hook integrally formed on the second shell; and an indent formed in the first shell and arranged to receive the hook, wherein when said cam lever is in said first position, said shells are secured together by engagement between structures on the cam lever and on the second shell, and also by engagement between said hook and said indent, and wherein when said cam lever is in said second position, said structures on said cam lever and on said second shell disengage to permit separation of said first and second shells, and disengagement between said hook and said indent.

2. A retractable knife as claimed in claim 1, wherein said engaging structures on said cam lever and on said second shell comprise a protuberance integrally formed in a cutout of the second shell and an aperture formed in the cam lever.

3. A retractable knife as claimed in claim 1, wherein said indent is formed in an anchor transversely extending from an inner surface of the first shell at a bottom end thereof such that anchor and a main portion of the first shell from which said anchor extends forms an L-shape.

4. A retractable knife as claimed in claim 1, wherein the hook is integrally formed on the bottom end face of the second shell.

5. A retractable knife as claimed in claim 1, wherein the indent is integrally formed in the upper face of an anchor integrally formed on an inner surface of the first shell.

6. A retractable knife as claimed in claim 1, wherein the cam lever is pivotally received in an opening in the first shell and includes two longitudinal side faces, wherein one longitudinal side face includes an aperture that is substantially semi-circular and a recess integrally formed with the aperture, said aperture being arranged to receive a protuberance on said second shell, said aperture and protuberance forming said engaging structures on said cam lever and second shell.

7. A retractable knife as claimed in claim 6, wherein said protuberance integrally extends from a top face of the second shell and is configured to be received in the aperture of the cam lever, and wherein the protuberance includes a stud arranged to be received in said recess.

8. A retractable knife as claimed in claim 7, wherein the stud engages the recess of the cam lever when the first and second shells are combined.

9. A retractable knife as claimed in claim 8, wherein the stud of the protuberance disengages from the recess of the cam lever when the user releases engagement between the first and second shells by pivoting the lever.

* * * * *